US005720074A

United States Patent [19]

Lee

[11] Patent Number: 5,720,074

[45] Date of Patent: Feb. 24, 1998

[54] VACUUM CLEANER HAVING A NOISE REDUCTION SYSTEM

[75] Inventor: Jae-Duck Lee, Seoul, Rep. of Korea

[73] Assignee: Daewoo Electronics Co., Ltd

[21] Appl. No.: 580,443

[22] Filed: Dec. 27, 1995

[30] Foreign Application Priority Data

Aug. 31, 1995 [KR] Rep. of Korea ..... 95-28291

[51] Int. Cl.[6] ..... A47L 9/22

[52] U.S. Cl. ..... 15/326; 15/327.7

[58] Field of Search ..... 15/326

[56] References Cited

U.S. PATENT DOCUMENTS

| | | | |
|---|---|---|---|
| 2,884,185 | 4/1959 | Dolan | 15/326 |
| 4,356,591 | 11/1982 | Lude | 15/326 |
| 4,665,581 | 5/1987 | Oberdorfer | 15/326 |
| 4,864,683 | 9/1989 | Herron et al. | 15/326 X |
| 5,159,738 | 11/1992 | Sunagawa et al. | 15/326 |
| 5,293,664 | 3/1994 | Lim et al. | 15/326 |
| 5,365,633 | 11/1994 | Sunagawa et al. | 15/326 |
| 5,400,463 | 3/1995 | Attard et al. | 15/326 |

FOREIGN PATENT DOCUMENTS

| | | | |
|---|---|---|---|
| 453296 | 10/1991 | Japan | 15/326 |
| 406030860 | 2/1994 | Japan | 15/326 |
| 1722454 | 3/1992 | U.S.S.R. | 15/326 |
| 1768135 | 10/1992 | U.S.S.R. | 15/326 |

*Primary Examiner*—Chris K. Moore

*Attorney, Agent, or Firm*—Beveridge, DeGrandi, Weilacher & Young LLP

[57] ABSTRACT

A vacuum cleaner having a noise reduction system which can effectively reduce noise is disclosed. The noise reduction system has a casing, a motor cap disposed in the casing such that it can surround a motor, a first sound-absorbing material provided in the inner wall of motor cap, and a second sound-absorbing material provided in the inner wall of the casing. The noise reduction system lengthens the fluid path in the vacuum cleaner so that air can fully contact the first and second sound-absorbing materials, thereby reducing the noise caused by friction between the sucking air and elements of the vacuum cleaner.

8 Claims, 4 Drawing Sheets

VACUUM CLEANER HAVING A NOISE REDUCTION SYSTEM

BACKGROUND OF THE INVENTION

The present invention relates to a vacuum cleaner, and more particularly to a vacuum cleaner having a noise reduction system which can effectively reduce noise while the vacuum cleaner operates.

Generally, a vacuum cleaner is an electrical appliance for removing dirt such as dust from carpets or floorings by suction.

In the vacuum cleaner, air which contains dirt passes through the interior of the vacuum cleaner and then exhausts out of the vacuum cleaner through an exhaust port. However, since the air is rapidly sucked into the vacuum cleaner, the sucked air strongly collides with elements disposed in the vacuum cleaner so that a loud noise is generated while the air passes through the interior of the vacuum cleaner.

In addition, since the vacuum cleaner uses a high-speed motor in order to suck the air with a strong force, not only is loud noise generated, but the vacuum cleaner vibrates intensely due to the high-speed revolution of the motor while operating.

These kinds of noise and vibrations are unpleasant to the user and shorten the life of the vacuum cleaner.

In order to overcome the above problems, various types of conventional vacuum cleaners for reducing noise as well as vibrations have been proposed, but they have presented many problems.

For example, U.S. patent application Ser. No. 08/249,217 of Lee et al. discloses "Brush assembly for a vacuum cleaner having a sound-absorbing system". However, Lee's brush assembly is intended to reduce the noise generated from the brush, so that Lee's brush assembly does not solve the problem of noise generated within a housing of the vacuum cleaner.

Accordingly, there is a necessity to provide a vacuum cleaner which can reduce the noise generated within the housing of the vacuum cleaner.

FIG. 5 shows one of the conventional vacuum cleaners.

As shown in FIG. 5, a conventional vacuum cleaner 500 includes a housing 510. Housing 510 has a suction port 520 through which air having dirt such as dust is sucked, a dust collecting chamber 530 for collecting the dust or trash contained in the sucked air, and a blowing chamber 540 for exhausting the sucked air out of vacuum cleaner 500 through an exhaust port 560. Blowing chamber 540 is separated from dust collecting chamber 530 by a compartment 550.

A trash bag 532 for storing the dirt contained in the sucked air is provided in dust collecting chamber 530, and blowing chamber 540 is provided with a sound-absorbing chamber 300 for receiving a blower assembly 200 and a supporting rib 380. Compartment 550 is formed with a plurality of fine pores (not shown) so that the sucked air can flow from dust collecting chamber 530 to blowing chamber 540. At both side walls of sound-absorbing chamber 300, there are formed an inlet hole 360 for guiding the sucked air into blower assembly 200 and an outlet hole 365 for discharging the air discharged from blower assembly 200 towards exhaust port 560, respectively.

While, blower assembly 200 includes a motor 210 and a rotating fan 220 rotated by motor 210. At the center of rotating fan 220, there is formed a suction opening 222 which sucks the air guided by inlet hole 360 of sound-absorbing chamber 300, and a discharge opening 212 for discharging the sucking air is formed in motor 210. A front damper 230 for reducing the vibration caused by rotating fan 220 or the sucked air is disposed between rotating fan 220 and the inner wall of sound-absorbing chamber 300, and a rear damper 370 for reducing the vibration caused by revolution of motor 210 or the discharging air is disposed between motor 210 and supporting rib 380.

In addition, a motor cap 320 for shielding the noise from motor 210 and for guiding the air discharged from discharging opening 212 of motor 210 into sound-absorbing chamber 300 is disposed around motor 210 in such a manner that motor cap 320 can surround motor 210.

Motor cap 320 is provided at its inner wall with a first sound-absorbing material 330 for absorbing the noise generated from motor 210. Further, sound-absorbing chamber 300 is provided at its inner wall with a second sound-absorbing material 340 so that the noise is further absorbed.

On the other hand, a filter 350 for filtering the air being exhausted out of vacuum cleaner 500 is attached to the inner wall of sound-absorbing chamber 300.

The conventional vacuum cleaner having the above structure operates as follows.

When a user turns on an operating switch, rotating fan 220 rotates by motor 210, thereby air having the dirt is sucked through suction port 520. Then, the sucked air is guided into suction opening 222 of rotating fan 220 through the fine pores of compartment 550 and inlet hole 360 of sound-absorbing chamber 300. At this time, compartment 550 filtrates the dust or trash contained in the sucked air so that the dirt remains in trash bag 532 of dust collecting chamber 530.

Next, as indicated by arrows 391 and 392 in FIG. 5, the air is strongly discharged upwards through discharging opening 212 of motor 210 while contacting first sound-absorbing material 330 provided in the inner wall of motor cap 320 and second sound-absorbing material 340 provided in the inner wall of sound-absorbing chamber 300. Upon contacting first and second sound-absorbing material 330 and 340, the pulsation of the air reduces so that the noise caused by the pulsation of air also reduces. Then the air is exhausted out of vacuum cleaner 500 through filter 350 and exhaust port 560.

In the meantime, the noise caused by the high-speed revolution of motor 210 is also transferred to the exterior of vacuum cleaner 500 along the air flow. The air flow comes in contact with first and second sound-absorbing materials 330 and 340.

However, conventional vacuum cleaner 500 has the disadvantages as follows.

Firstly, the length of the fluid path formed between discharging opening 212 of motor 210 and outlet hole 365 of sound-absorbing chamber 300 is so short that the air which flows along the fluid path does not sufficiently contact with the first sound-absorbing material 330 and second sound-absorbing material 340, thereby causing a loud noise.

Further, since the length of the fluid path formed between outlet hole 365 of sound-absorbing chamber 300 and exhaust port 560 is also so short that the noise caused by high-speed revolution of motor 210 may be rapidly transferred to the exterior of vacuum cleaner 500 without being sufficiently absorbed in vacuum cleaner 500.

SUMMARY OF THE INVENTION

The present invention has been made to overcome the above described problems of the prior art, and accordingly it is an object of the present invention to provide a vacuum cleaner having a noise reduction system which can effectively reduce a noise while the vacuum cleaner operates.

To achieve the above object, the present invention provides a vacuum cleaner comprising:

a housing having a suction port for sucking an air including dirt, a dust collecting chamber for collecting the dirt included in the air, and a blowing chamber for exhausting the sucked air out of the vacuum cleaner through an exhaust port, the blowing chamber being separated from the dust collecting chamber by a compartment;

a blower assembly for generating a suction force so as to suck the air through the suction port, the blower assembly including a motor and a rotating fan rotated by the motor;

a motor cap for absorbing a noise generated by the air being discharged from the blower assembly, the motor cap being incorporated with the blower assembly in order to form a first fluid path therebetween, the first fluid path directions of the air that has discharged from the blower assembly so as to lengthen a first flow length of the air, the air being fully in contact with the motor cap through the first fluid path; and a casing for absorbing a noise generated by the air being discharged from the motor cap, the casing being incorporated with the motor cap in order to form a second fluid path therebetween.

According to a preferred embodiment of the present invention, the casing includes a front casing and a rear casing securely assembled to the front casing. The motor cap is provided at its inner wall with a first sound-absorbing material for absorbing the noise generated by the air being discharged from the motor, and the rear casing is provided at its inner wall with a second sound-absorbing material for absorbing the noise generated by the air being discharged from the motor cap.

In addition, the vacuum cleaner further comprises a third sound-absorbing material disposed between the front casing and the rear casing so as to prevent the noise generated in the front casing from being transferred to the rear casing, a front damper disposed between the rotating fan and an inner wall of the front casing for reducing vibrations caused by the rotating fan, and a rear damper attached to a rear portion of the motor cap for reducing vibrations caused by a revolution of the motor.

The from casing has an inlet hole for guiding the air from the suction port into the blower assembly, and the rear casing has a plurality of outlet holes for discharging the air from the blower assembly into the bottom wall of the blowing chamber.

The motor cap has an oval shape, and is formed at its upper portion with a first and second cutting portions. In addition, the first and second cutting portions are disposed in opposition to the outlet holes of the rear casing such that the length of the second fluid path can be maximized.

The vacuum cleaner having the above structure operates as follows.

When a user turns on an operating switch, the rotating fan rotates by the motor thereby air having dirt is sucked through the suction port. Then, the sucked air is guided into a suction opening of the rotating fan. At this time, the dirt remains in a trash bag of the dust collecting chamber.

Next, the sucked air is discharged through a discharge opening of the motor, and then flows along the inner wall of the motor cap.

While flowing along the inner wall of the motor cap, the air comes in contact with the first sound-absorbing material provided in the inner wall of the motor cap so that the fluctuation of the discharged air may be relieved and thereby the noise can be reduced.

Next, the air is discharged into the rear casing through the first and second cutting portions, and flows again along the inner wall of the rear casing. While flowing along the inner wall of the rear casing, the air comes in contact with the second sound-absorbing material provided in the inner wall of the rear casing so that the fluctuation and noise of the discharged air may be reduced.

The air fully contacts the second sound-absorbing material so that noise is greatly reduced.

Thereafter, the air having the reduced noise is discharged towards the bottom wall of the blowing chamber through the outlet holes of the rear casing, and is exhausted out of the vacuum cleaner through the exhaust port.

On the other hand, the noise caused by the high-speed revolution of the motor is also transferred to the exterior of the vacuum cleaner through the exhaust port along the air flow. However, the air flow noise comes in contact with the first and second sound-absorbing materials, and moreover, the length from the noise source to the exterior of the vacuum cleaner is so long that the noise generated from the motor may also be effectively reduced.

As described above, according to the present invention, the fluid path extended from the discharge opening of the motor to the outlet hole of the casing is lengthened. Therefore, the air which flows along the fluid path can sufficiently contact the first and second sound-absorbing materials, thereby reducing a loud noise.

Further, since the exhaust path of the air formed between the outlet hole of the casing and the exhaust port is also lengthened, the length from the noise source to the exterior of the vacuum cleaner is also lengthened so that the noise generated from the motor may be effectively reduced.

BRIEF DESCRIPTION OF THE DRAWINGS

The above objects and other advantages of the present invention will become more apparent by describing in detail preferred embodiments thereof with reference to the attached drawings, in which.

DESCRIPTION OF THE PREFERRED EMBODIMENTS

Hereinafter, the present invention will be described in detail with reference to the accompanying drawings.

Figure 1:
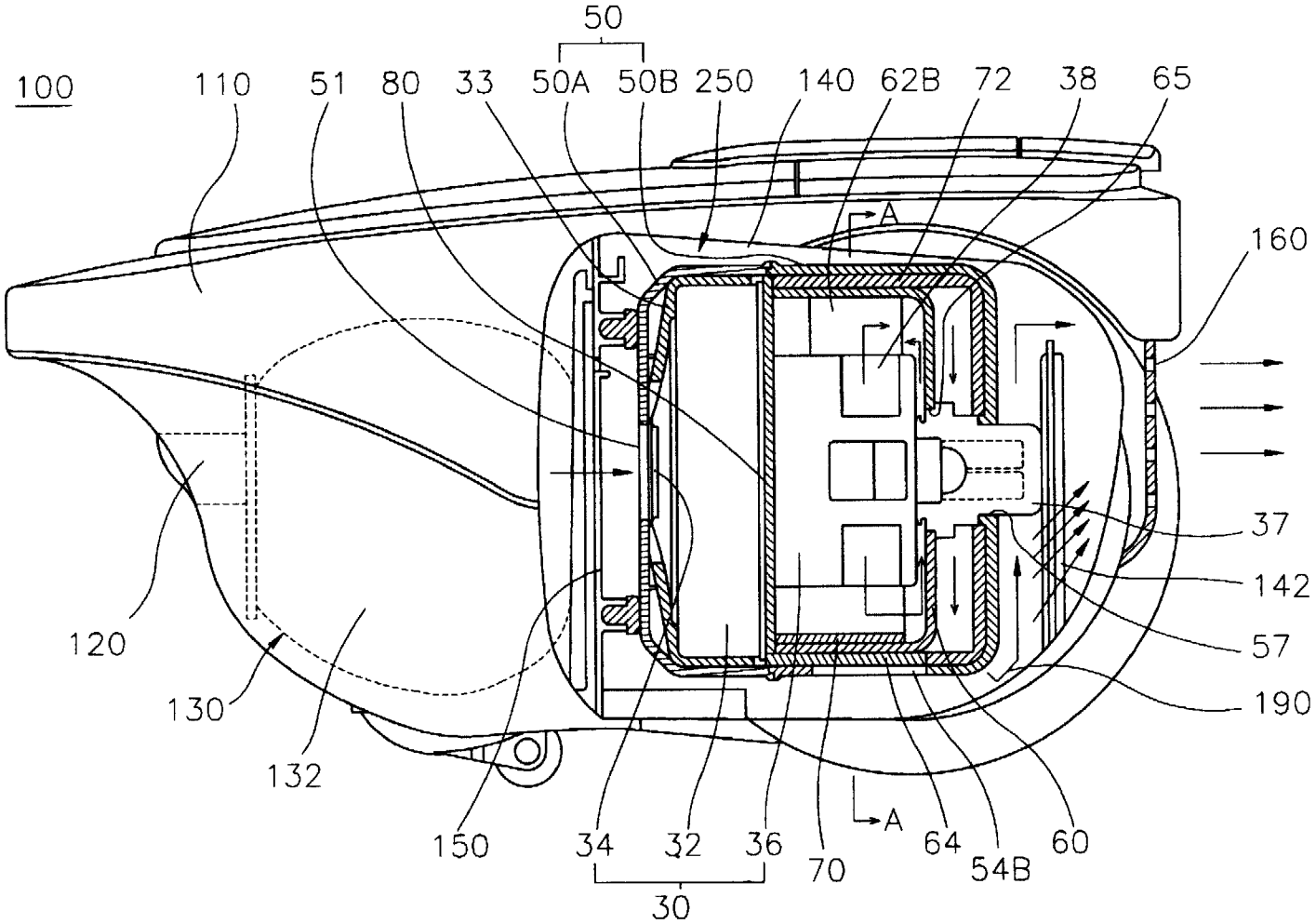
FIG. 1 is a partial sectional view for showing the interior of the vacuum cleaner according to one embodiment of the present invention.

FIG. 1 shows the interior of vacuum cleaner 100 according to one embodiment of the present invention.

As shown in FIG. 1, vacuum cleaner 100 includes a housing 110. Housing 110 has a suction port 120 through which air having dirt such as dust or trash is sucked, a dust collecting chamber 130 for collecting the dust or trash contained in the sucked air, and a blowing chamber 140 for exhausting the sucked air out of vacuum cleaner 100 through an exhaust port 160. Blowing chamber 140 is separated from dust collecting chamber 130 by a compartment 150.

A trash bag 132 for storing the dirt contained in the sucked air is provided in dust collecting chamber 130, and a noise reduction system 250 is accommodated in blowing chamber 140. Compartment 150 is formed with a plurality of fine pores (not shown) so that the sucked air can flow from dust collecting chamber 130 to blowing chamber 140.

Sound reduction system 250 includes a front casing 50A and a rear casing 50B which are incorporated with each other so as to form a casing 50. A blower assembly 30 for generating suction force is accommodated in casing 50, and a support rib 142 is disposed at a predetermined position apart from casing 50 so as to support casing 50.

Figure 2:
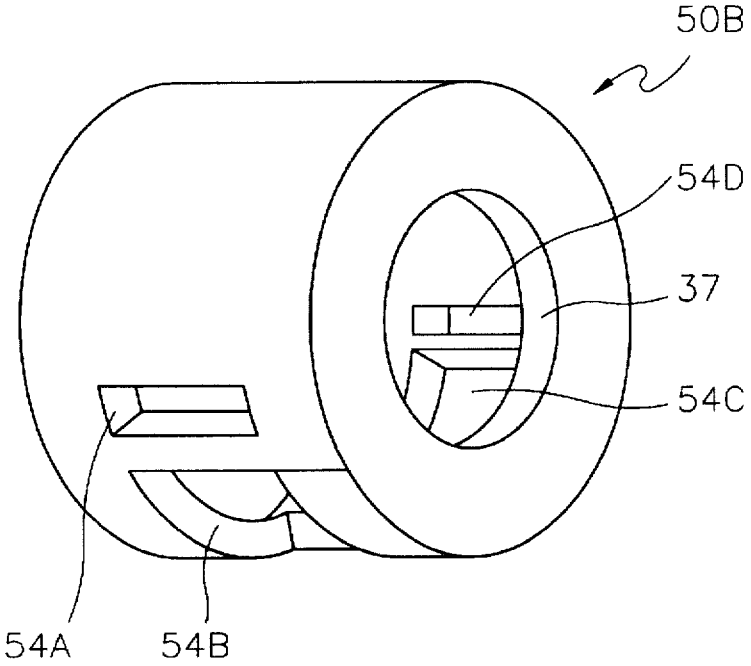
FIG. 2 is a perspective view of a rear casing shown in FIG. 1.

Front casing 50A has an inlet hole 51 for guiding the air from suction port 120 into blower assembly 30, and, as shown in FIG. 2, rear casing 50B has a plurality of outlet holes 54A, 54B, 54C and 54D for discharging the air from blower assembly 30 into blowing chamber 140. The plurality of outlet holes 54A, 54B, 54C and 54D are covered by a filter 64 so that the air may be discharged into blowing chamber 140 after it has been purged by filter 64.

The number and size of the outlet holes can be varied according to embodiments thereof. In this embodiment, four outlet holes are provided at a predetermined position of the periphery wall of rear casing 50B in such a manner that the air can be discharged towards the bottom wall of blowing chamber 140.

Blower assembly 30 includes a motor 36 and a rotating fan 32 rotated by motor 36. At the center of rotating fan 32, there is formed a suction opening 34 which sucks the air guided by inlet hole 51 of casing 50, and a plurality of discharge openings 38 for discharging the sucking air is regularly formed around the periphery wall of motor 36.

In addition, a motor cap 60 for shielding the noise from motor 36 and for guiding the air discharged from discharge openings 38 of motor 36 into rear casing 50B is disposed around motor 36 in such a manner that motor cap 60 can surround motor 36.

Figure 3:
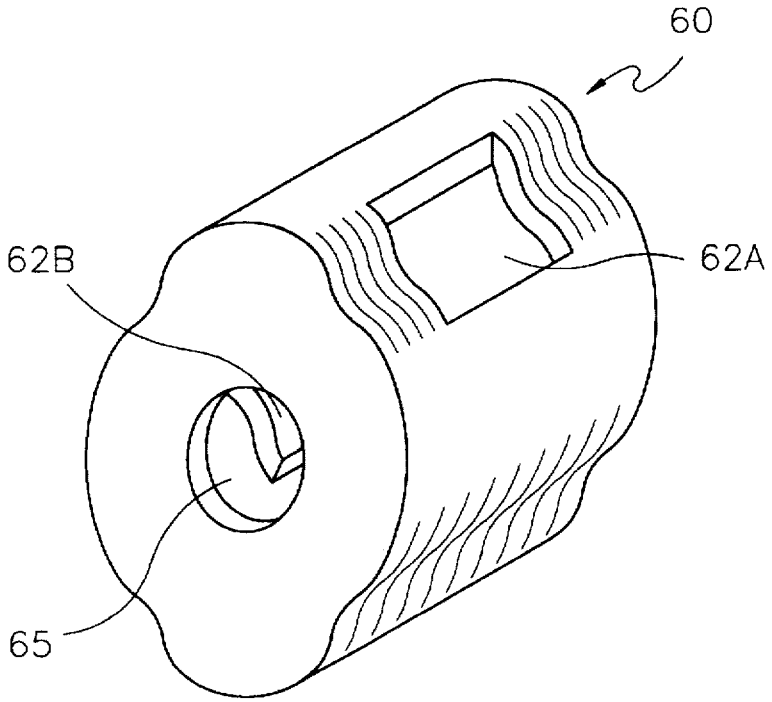
FIG. 3 is a perspective view of a motor cap shown in FIG. 1.

As shown in FIG. 3, motor cap 60 has an oval shape and first and second cutting portions 62A and 62B are formed at the upper portion of motor cap 50 in such a manner that the air can be discharged from discharge openings 38 of motor 36 into rear casing 50B. In addition, first and second cutting portions 62A and 62B are disposed in opposition to outlet holes 54A, 54B, 54C and 54D such that the length of the fluid path can be maximized.

Referring again to FIG. 1, motor cap 60 is provided at its inner wall with a first sound-absorbing material 70 for absorbing the noise caused by high-speed revolution of motor 36 and the fluctuation of the discharging air. Further, rear casing 50B is provided at its inner wall with a second sound-absorbing material 72 so that the noise is further absorbed.

In addition, a third sound-absorbing material 80 is provided between front casing 50A and rear casing 50B so as to prevent the noise generated in front casing 50A from being transferred to rear casing 50B.

A front damper 33 for reducing the vibration caused by rotating fan 32 or the fluctuation of the sucking air is disposed between rotating fan 32 and the inner wall of front casing 50A, and a rear damper 37 extended through a hole 65 of motor cap 60 and perforation opening 57 of rear casing 50B for reducing the vibrations caused by the revolution of motor 36 or the discharging air is disposed between motor 36 and supporting rib 142.

The vacuum cleaner 100 having the above structure according to the present invention operates as follows.

When a user turns on an operating switch, rotating fan 32 rotates by motor 36 thereby air having the dirt is sucked through suction port 120. Then, the sucked air is guided into suction opening 34 of rotating fan 32 through the fine pores of compartment 150 and inlet hole 51 of front casing 50A.

At this time, compartment 150 filtrates the dust or trash contained in the sucked air so that the dirt remains in trash bag 132 of dust collecting chamber 130. In addition, since front damper 33 is disposed between rotating fan 32 and front casing 50A, the vibrations which are generated from rotating fan 32 while the air is sucked into suction opening 34 of rotating fan 32, can be reduced.

Figure 4:
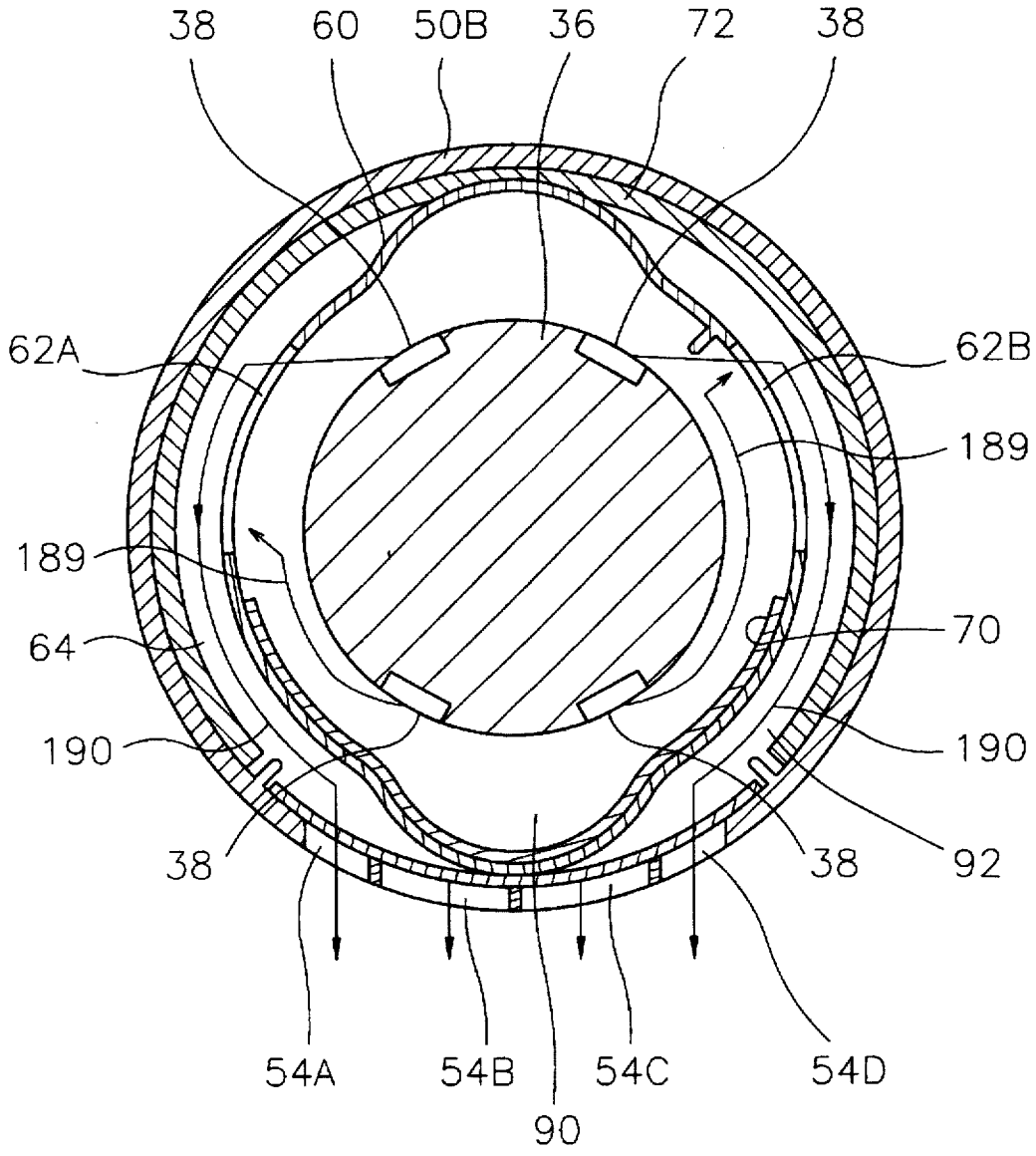
FIG. 4 is a sectional view taken along with the line A—A in FIG. 1.
Figure 5:
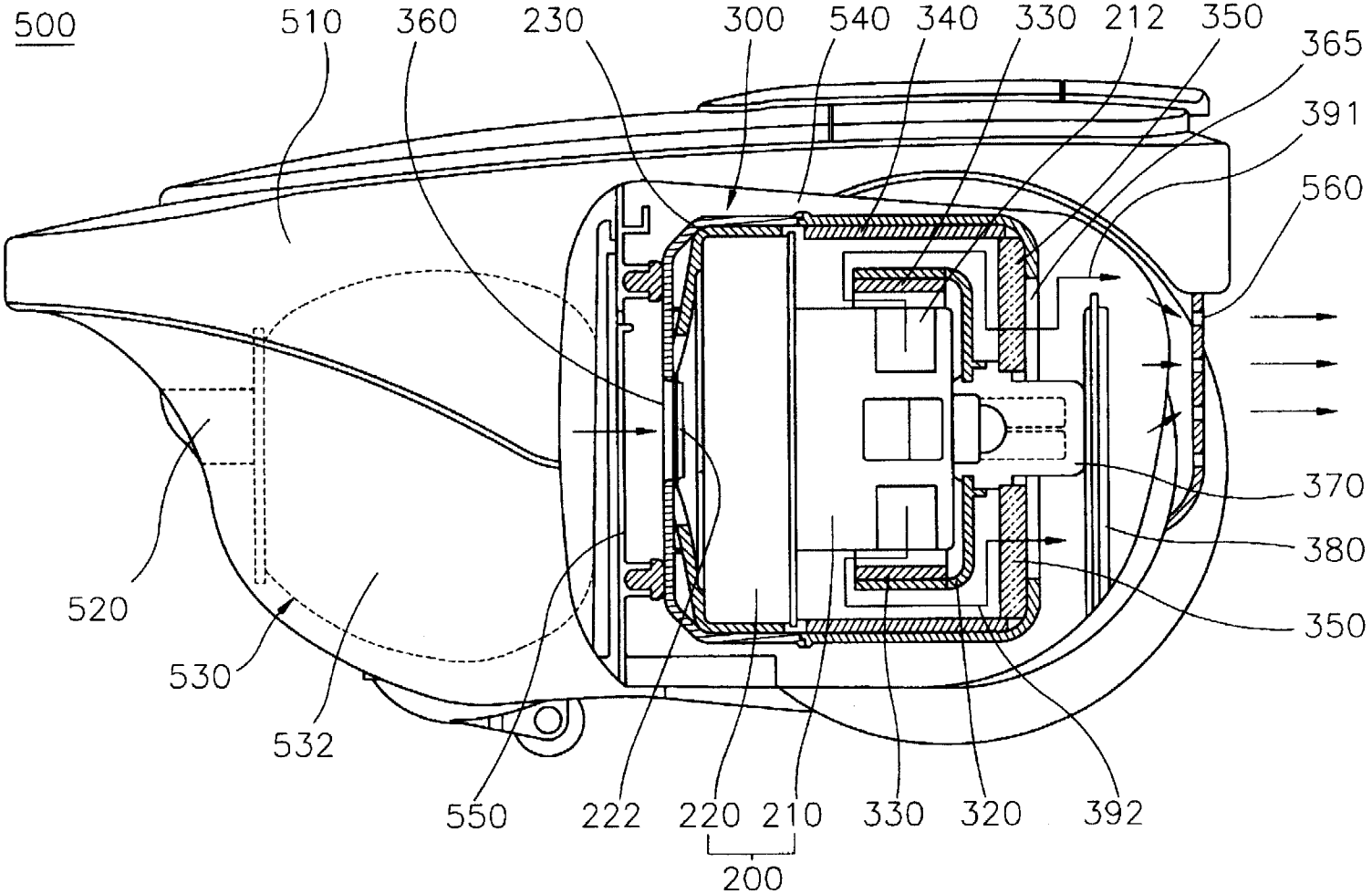
FIG.5 (PRIOR ART)
FIG. 5 is a partial sectional view for showing the interior of the conventional vacuum cleaner.

Next, as shown in FIG. 4, the sucked air is discharged through discharge opening 38 of motor 36 into a first space 90 formed between motor 36 and motor cap 60, and then flowed along the inner wall of motor cap 60.

As stated above, since blower assembly 30 strongly sucks and discharges the air, the air discharged from motor 36 has a powerful fluctuation so that a loud noise is caused by the discharged air.

In order to reduce the loud noise, first sound-absorbing material 70 is provided in the inner wall of motor cap 60. That is, the air that has discharged from motor 36 comes in contact with first sound-absorbing material 70 provided in the inner wall of motor cap 60 while flowing along the inner wall of motor cap 60, so that the fluctuation of the discharged air may be relieved and thereby the noise can be reduced.

According to one embodiment of the present invention, some of the air is discharged to the bottom wall of motor cap 60 and flows towards upper wall of motor cap 60. Therefore, as indicated by arrow 189 in FIG. 4, the air flows through first the space 90 for a long time while contacting first sound-absorbing material 70, thereby the noise and fluctuation of the air can be greatly reduced.

Next, the air is discharged into a second space 92 formed between motor cap 60 and rear casing 50B through first and second cutting portions 62A and 62B of motor cap 60.

The air that has flowed into second space 92 is guided again along the inner wall of rear casing 50B while fully contacting second sound-absorbing material 72, and thereby further reducing the noise.

According to one embodiment of the present invention, first and second cutting portions 62A and 62B are disposed in opposition to outlet holes 54A, 54B, 54C and 54D such that the length of the fluid path in second space 92 can be maximized.

Therefore, as indicated by arrow 190 in FIG. 4, the air that has flowed into second space 92 flows from the upper inner wall to lower inner wall of motor cap 60, so that the air may fully contact second sound-absorbing material 72 provided in the inner wall of rear casing 50B, thereby the fluctuation of the air as well as the noise therefrom can be effectively relieved.

Thereafter, the air having the reduced noise is purged through filter 64 and discharged towards the bottom wall of blowing chamber 140 by way of outlet holes 54A, 54B, 54C and 54D of rear casing 50B.

Meanwhile, the air that has discharged to the bottom wall of blowing chamber 140 again moves upwards so as to exhaust out of vacuum cleaner 100. In this manner, the exhaust path of the air extended from outlet holes 54A, 54B, 54C and 54D to exhaust port 160 is lengthened, and thereby the noise being transferred to the exterior of vacuum cleaner is further reduced.

On the other hand, the noise caused by the high-speed revolution of motor 36 is also transferred to the exterior of vacuum cleaner 100 through exhaust port 160 along the air flow. However, the air flow comes in contact with first and second sound-absorbing materials 70 and 72, and moreover, the length from the noise source to the exterior of vacuum cleaner 100 is so long that the noise generated from motor 36 may also be effectively reduced.

According to an experiment executed by the inventor of this application, the noise level of the vacuum cleaner according to the present invention is measured at 58.9 dB, and that of the conventional vacuum cleaner is measured at 60.4 dB.

As described above, according to the present invention, the fluid path extended from the discharge opening of the motor to the outlet hole of the casing is lengthened. Therefore, the air which flows along the fluid path can sufficiently contact the first and second sound-absorbing materials, thereby reducing the loud noise.

Further, since the exhaust path of the air formed between the outlet hole of the casing and the exhaust port is also lengthened, the length from the noise source to the exterior of the vacuum cleaner is also lengthened so that the noise generated from the motor may be effectively reduced.

While the present invention has been particularly shown and described with reference to the preferred embodiment thereof, it will be understood by those skilled in the art that various changes in form and details may be effected therein without departing from the spirit and scope of the invention as defined by the appended claims.

What is claimed is:

1. A vacuum cleaner comprising:

a housing having a suction port for sucking air including dirt, a dust collecting chamber for collecting the dirt included in the air, and a blowing chamber for exhausting the sucked air out of the vacuum cleaner through an exhaust port, the blowing chamber being separated from the dust collecting chamber by a compartment;

a blower assembly for generating a suction force so as to suck the air through the suction port, the blower assembly including a motor and a rotating fan rotated by the motor, the rotating fan having a suction opening for sucking the air at a center thereof, the motor being formed at its periphery wall with a plurality of discharge openings for discharging the sucked air;

a motor cap surrounding the motor, the motor cap being formed with first and second discharge holes for discharging the air discharged from the discharge openings of the motor, the motor cap being provided at its inner wall with a first sound-absorbing element for absorbing a noise, the motor cap being incorporated with the motor in order to form a first fluid path therebetween, the first fluid path guiding the sucked air toward an upper portion of the motor cap;

a casing accommodated in the blowing chamber, the casing having a front casing and a rear casing securely assembled to the front casing, the rear casing being provided at its inner wall with a second sound-absorbing element for absorbing the noise;

a front damper disposed between the rotating fan and an inner wall of the front casing for reducing a first vibration caused by the rotating fan; and a rear damper attached to a rear portion of the motor cap for reducing a second vibration caused by a revolution of the motor, wherein the motor cap is accommodated in the casing, the casing is incorporated with the motor cap in order to form a second fluid path therebetween, and the second fluid path guides the sucked air toward a bottom portion of the motor cap.

2. The vacuum cleaner as claimed in claim 1, wherein the first and second discharge holes are formed at the upper portion of the motor cap.

3. The vacuum cleaner as claimed in claim 1, wherein the motor cap has an oval shape.

4. The vacuum cleaner as claimed in claim 1, further comprising a third sound-absorbing material disposed between the front casing and the rear casing so as to prevent the noise generated in the front casing from being transferred to the rear casing.

5. The vacuum cleaner as claimed in claim 1, wherein the from casing has an inlet hole for guiding the air from the suction port into the blower assembly, and the rear casing has a plurality of outlet holes for discharging the air from the blower assembly into the blowing chamber.

6. The vacuum cleaner as claimed in claim 5, wherein the outlet holes are opened towards a bottom wall of the blowing chamber in such a manner that the air which passes through the outlet holes can be discharged towards the bottom wall of the blowing chamber.

7. The vacuum cleaner as claimed in claim 5, wherein the first and second discharge holes are disposed in opposition to the outlet holes such that the length of the second fluid path is maximized.

8. A vacuum cleaner comprising:

a housing having a suction port for sucking air including dirt, a dust collecting chamber for collecting the dirt included in the air, and a blowing chamber for exhausting the sucked air out of the vacuum cleaner through an exhaust port, the blowing chamber being separated from the dust collecting chamber by a compartment;

a blower assembly for generating a suction force so as to suck the air through the suction port, the blower assembly including a motor and a rotating fan rotated by the motor, the rotating fan having a suction opening for sucking the air at a center thereof, the motor being formed at its periphery wall with a plurality of discharge openings for discharging the sucked air;

a motor cap surrounding for absorbing a noise generated by the air being discharge from the motor, the motor cap being incorporated with the motor in order to form a first fluid path therebetween for guiding the sucked air toward an upper portion of the motor cap, the motor cap being formed at its upper portion with first and second discharge holes for discharging the air discharged from the discharge openings of the motor, the motor cap having an oval shape, the motor cap being provided at its inner wall with a first sound-absorbing material for absorbing the noise generated by the air being discharged from the motor;

a casing surrounding the motor cap for absorbing a noise generated by the air being discharge from the motor cap, the casing being accommodated in the blowing chamber, the casing including a front casing and rear casing securely assembled to the front casing, the front casing having an inlet hole for guiding the air from the suction port into the blower assembly, the rear casing having a plurality of outlet holes for discharging the air from the blower assembly into the blowing chamber, the outlet holes being opened towards a bottom wall of the blowing chamber in such a manner that the air which passes through the outlet holes is discharged towards the bottom wall of the blowing chamber, the outlet holes being disposed in opposition to the first and second discharge holes of the motor cap, the rear casing being provided at its inner wall with a second sound-absorbing material for absorbing the noise, the rear casing being incorporated with the motor cap in order to form a second fluid path therebetween for guiding the sucked air toward a bottom portion of the motor cap;

a third sound-absorbing material disposed between the front casing and the rear casing so as to prevent the noise generate in the front casing from being transferred to the rear casing;

a front damper disposed between the routing fan and an inner wall of the from casing for reducing a first vibration caused by the rotating fan; and a rear damper attached to a rear portion of the motor cap for reducing a second vibration caused by a revolution of the motor.

* * * * *